US007195654B2

(12) United States Patent
Jackson et al.

(10) Patent No.: US 7,195,654 B2
(45) **Date of Patent: *Mar. 27, 2007**

(54) GASOLINE ADDITIVE CONCENTRATE COMPOSITION AND FUEL COMPOSITION AND METHOD THEREOF

(75) Inventors: Mitchell M. Jackson, Chagrin Falls, OH (US); Keith C. Corkwell, Newbury, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 32 days.

This patent is subject to a terminal disclaimer.

(21) Appl. No.: 09/820,430

(22) Filed: Mar. 29, 2001

(65) Prior Publication Data

US 2002/0174597 A1 Nov. 28, 2002

(51) Int. Cl.
*C10L 1/18* (2006.01)
*C10L 1/22* (2006.01)

(52) U.S. Cl. ..... 44/388; 44/389; 44/411; 44/412; 44/415; 44/423; 44/434

(58) Field of Classification Search ..... 44/412, 44/387, 385, 389, 423, 434, 411, 415, 388, 44/397

See application file for complete search history.

(56) References Cited

U.S. PATENT DOCUMENTS

| | | | | |
|---|---|---|---|---|
| 3,250,715 | A * | 5/1966 | Wyann | |
| 3,287,273 | A * | 11/1966 | Furey et al. | |
| 3,877,889 | A * | 4/1975 | Dix | |
| 4,129,508 | A * | 12/1978 | Friihauf | |
| 4,609,376 | A * | 9/1986 | Craig et al. | |
| 4,617,026 | A | 10/1986 | Shaub et al. | 44/70 |
| 5,094,667 | A * | 3/1992 | Schilowitz et al. | 44/434 |
| 5,407,453 | A * | 4/1995 | Pierce-Ruhland et al. | 44/411 |
| 5,503,645 | A * | 4/1996 | Jung et al. | 44/418 |
| 5,697,988 | A * | 12/1997 | Malfer | 44/415 |
| 5,720,782 | A * | 2/1998 | Schilowitz et al. | 44/300 |
| 5,833,722 | A | 11/1998 | Davies et al. | 44/418 |
| 5,876,468 | A * | 3/1999 | Moreton | 44/415 |
| 5,968,211 | A | 10/1999 | Schilowitz | 44/402 |
| 6,203,584 | B1 | 3/2001 | Fuentes-Afflick et al. | 44/387 |
| 6,224,642 | B1 * | 5/2001 | Daly et al. | 44/434 |

FOREIGN PATENT DOCUMENTS

| | | | |
|---|---|---|---|
| EP | 0227 218 | A1 | 7/1987 |
| EP | 0869 163 | A1 | 10/1998 |
| EP | 0947576 | A1 * | 6/1999 |
| EP | 0957 152 | A1 | 11/1999 |
| JP | 58117282 | * | 7/1983 |

OTHER PUBLICATIONS

International Publication No. WO93/21288, Block et al., published Oct. 28, 1993.

* cited by examiner

*Primary Examiner*—Cephia D. Toomer
(74) *Attorney, Agent, or Firm*—Jason S. Fokens; Michael F. Esposito

(57) ABSTRACT

A gasoline additive concentrate composition comprises a solvent, an alkoxylated fatty amine, and a partial ester having at least one free hydroxyl group and formed by reacting at least one fatty carboxylic acid and at least one polyhydric alcohol. A fuel composition comprises gasoline and the gasoline additive concentrate composition. A method of operating a gasoline internal combustion engine comprises fueling the engine with the fuel composition and is effective in reducing fuel consumption.

15 Claims, No Drawings

GASOLINE ADDITIVE CONCENTRATE COMPOSITION AND FUEL COMPOSITION AND METHOD THEREOF

BACKGROUND OF THE INVENTION

1. Field of the Invention

This invention involves a gasoline additive concentrate composition, a fuel composition that includes the gasoline additive concentrate composition, and a method of operating a gasoline internal combustion engine with the fuel composition. The compositions and methods of the present invention reduce fuel consumption in a gasoline internal combustion engine.

2. Description of the Related Art

Gasoline fuel compositions that reduce the fuel consumption of internal combustion engines are both beneficial and desirable to reduce fuel costs and to comply with governmental regulations concerning fuel economy and exhaust emissions.

U.S. patent application Ser. No. 09/448,560 filed Nov. 23, 1999 (Adams et al.) disclose compositions that include a polyetheramine and compounds selected from the group that includes fatty acid esters and alkoxylated amines that are useful as fuel additives for reducing engine wear and improving fuel economy.

International Application No. WO 93/21288 published Oct. 28, 1993 (Bloch et al.) disclose lubricating oils, such as engine oils and transmission fluids, that include an alkoxylated amine and an ester of a fatty acid which provide enhanced fuel economy.

U.S. Pat. No. 5,968,211 filed May 26, 1998 (Schilowitz) discloses gasoline lubricity additive concentrates that include esters of fatty acids and alkoxylated amines.

European Publication No. EP 947576 published Oct. 6, 1999 (Fuentes-Afflick et al.) disclose fuel compositions that include aliphatic hydrocarbyl substituted amines and/or polyetheramines and esters of carboxylic acids and polyhydric alcohols to improve fuel economy.

U.S. Pat. No. 4,617,026 filed Aug. 15, 1984 (Shaub et al.) disclose a method to reduce fuel comsumption in a gasoline engine by including a fuel additive that is an ester having at least one free hydroxyl group and formed from a monocarboxylic acid and a glycol or trihydric alcohol.

U.S. Pat. No. 5,833,722 filed Aug. 9, 1996 (Davies et al.) disclose fuel compositions that include a fuel oil having a low sulfur content, a nitrogen containing compound such as the salt of an amine and carboxylic acid, and an ester of a polyhydric alcohol and a carboxylic acid to enhance lubricity of the fuel.

It has now been found that the gasoline additive concentrate composition of the present invention when used in a fuel composition provides a way to reduce fuel consumption in gasoline internal combustion engines. The benefits of this invention are both economic and environmental and include reduced fuel costs, fuel conservation, and reduced emission of greenhouse gases.

SUMMARY OF THE INVENTION

It is an object of the present invention to increase fuel economy, reduce fuel consumption, and reduce combustion emissions in gasoline internal combustion engines.

It is a further object of the present invention to decrease engine wear in gasoline internal combustion engines.

The objects, advantages and embodiments of the present invention are in part described in the specification and in part are obvious from the specification or from the practice of this invention. Therefore, it is understood that the invention is claimed as described or obvious as falls within the scope of the appended claims.

To achieve the foregoing objects in accordance with the invention as described and claimed herein, a gasoline additive concentrate composition of this invention comprises a solvent and an alkoxylated fatty amine, and a partial ester having at least one free hydroxyl group and formed by reacting at least one fatty carboxylic acid and at least one polyhydric alcohol.

In another embodiment of the present invention, the gasoline additive concentrate composition further comprises a pour point depressant.

In an additional embodiment of this invention, the gasoline additive concentrate composition further comprises a nitrogen-containing detergent selected from the group consisting of a polyetheramine, an aliphatic hydrocarbon-substituted amine, a Mannich reaction product formed by reacting an aliphatic hydrocarbon-substituted phenol and an aldehyde and an amine, and mixtures of two or more thereof.

A further embodiment of the present invention is a fuel composition comprising gasoline and the foregoing gasoline additive concentrate composition.

A still further embodiment of this invention is a method of operating a gasoline internal combustion engine comprising fueling the engine with the foregoing fuel composition.

DETAILED DESCRIPTION OF THE INVENTION

A gasoline additive concentrate composition of the present invention comprises a solvent, and an alkoxylated fatty amine, and a partial ester having at least one free hydroxyl group and formed by reacting at least one fatty carboxylic acid and at least one polyhydric alcohol.

The solvent in the present invention provides for a homogeneous and liquid gasoline additive concentrate composition and for facile transferring and handling of the concentrate composition. The solvent also provides for a homogeneous fuel composition comprising gasoline and the concentrate composition. The solvent is selected from the group consisting of aliphatic hydrocarbons, aromatic hydrocarbons, alcohols, and mixtures of two or more thereof. The solvent generally boils in the range of about 65° C. to 235° C.

Aliphatic hydrocarbons include various naphtha and kerosene boiling point fractions that have a majority of aliphatic components.

Aromatic hydrocarbons include benzene, toluene, xylenes and various naphtha and kerosene boiling point fractions that have a majority of aromatic components.

Alcohols are usually aliphatic alcohols having about 2 to 10 carbon atoms and include ethanol, 1-propanol, isopropyl alcohol, 1-butanol, isobutyl alcohol, amyl alcohol, and 2-methyl-1-butanol.

The concentrate composition of the present invention is prepared by blending the components at ambient or an elevated temperature up to about 65° C. until the composition is homogeneous. The solvent can be present in the concentrate composition at about 10 to 90% by weight, preferably at about 25 to 85% by weight, and more preferably at about 40 to 80% by weight. Preferred solvents are aromatic hydrocarbons and mixtures of alcohols with aromatic hydrocarbons or kerosenes having some aromatic content that allow the concentrate composition to be a liquid at a temperature from about 0° C. to minus 18° C.

The alkoxylated fatty amine of the present invention includes amines represented by the formula

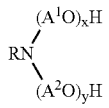

where R is a hydrocarbyl group having about 4 to 30 carbon atoms, $A^1$ and $A^2$ are vicinal alkylene groups, and the sum of x and y is an integer and is at least 1. The hydrocarbyl group is a univalent radical of carbon atoms that is predominantly hydrocarbon in nature, but can have nonhydrocarbon substituent groups and can have heteroatoms. The hydrocarbyl group R can be an alkyl or alkylene group of about 4 to 30 carbon atoms, preferably about 10 to 22 carbon atoms. The vicinal alkylene groups $A^1$ and $A^2$ can be the same or different and include ethylene, propylene and butylene having the carbon to nitrogen and carbon to oxygen bonds on adjacent or neighboring carbon atoms. Examples of alkoxylated fatty amines include diethoxylated tallowamine, diethoxylated oleylamine, diethoxylated stearylamine, and the diethoxylated amine from soybean oil fatty acids. Alkoxylated fatty amines are commercially available from Akzo under the Ethomeen® series.

The partial ester of the present invention has at least one free hydroxyl group and is formed by reacting at least one fatty carboxylic acid and at least one polyhydric alcohol.

The fatty carboxylic acid used to form the partial ester can be saturated or unsaturated aliphatic, can be branched or straight chain, can be a monocarboxylic or polycarboxylic acid, and can be a single acid or mixture of acids. The fatty carboxylic acid can have about 4 to 30 carbon atoms, 8 to 26 carbon atoms in another instance, and 12 to 22 carbon atoms in yet another instance. Saturated and unsaturated monocarboxylic acids are useful and include capric, lauric, myristic, palmitic, stearic, behenic, oleic, petroselinic, elaidic, palmitoleic, linoleic, linolenic and erucic acid.

The polyhydric alcohol used to form the partial ester has two or more hydroxyl groups and includes alkylene glycols, polyalkylene glycols, triols, polyols having more than three hydroxyl groups, and mixtures thereof. Examples of polyhydric alcohols include ethylene glycol, diethylene glycol, neopentyl glycol, glycerol, trimethylol propane, pentaerythritol, and sorbitol.

The partial esters of the present invention, having at least one free hydroxyl group, are commercially available or can be formed by a variety of methods well known in the art. These esters are derived from any of the above described fatty carboxylic acids and polyhydric alcohols or mixtures thereof. Preferred esters are derived from fatty carboxylic acids having about 12 to 22 carbon atoms and glycerol, and will usually be mixtures of mono- and diglycerides. A preferred partial ester is a mixture of glycerol monooleate and glycerol dioleate.

The gasoline additive concentrate composition of this invention further comprises a polymeric pour point depressant. The pour point depressant can further enhance the fluidity, homogeneity, transferring and handling of the concentrate composition especially at a temperature from about 0° C. to minus 18° C. Polymeric pour point depressants include polymethacrylates, polyacrylates, esterified copolymers of maleic anhydride and styrene, copolymers of ethylene and vinyl acetate, and terpolymers of dialkyl fumarates with vinyl esters and vinyl ethers. A preferred pour point depressant is the terpolymer prepared from a di($C^{12-14}$ alkyl) fumarate, vinyl acetate and vinyl ethyl ether as described in U.S. Pat. No. 3,250,715. The pour point depressant can be present in the concentrate composition at about 0.0001% to 15% by weight, at about 0.001% to 10% by weight in another instance, and at about 0.01% to 10% by weight in yet another instance.

The gasoline additive concentrate composition of the present invention further comprises a nitrogen-containing detergent selected from the group consisting of a polyetheramine, an aliphatic hydrocarbon-substituted amine, and a Mannich reaction product formed by reacting an aliphatic hydrocarbon-substituted phenol and aldehyde and an amine, and mixtures of two or more thereof.

The polyetheramines of the present invention can be represented by the formula $R[OCH_2CH(R^1)]_nA$ where R is a hydrocarbyl group as described above for alkoxylated fatty amines; $R^1$ is selected from the group consisting of hydrogen, hydrocarbyl groups of 1 to 16 carbon atoms, and mixtures thereof; n is a number from 2 to about 50; and A is selected from the group consisting of $—OCH^2CH_2CH_2NR^2R^2$ and $—NR^3R^3$ where each $R^2$ is independently hydrogen or hydrocarbyl, and each $R^3$ is independently hydrogen, hydrocarbyl or $—[R^4N(R^5)]_pR^6$ where $R^4$ is $C_2$–$C_{10}$ alkylene, $R^5$ and $R^6$ are independently hydrogen or hydrocarbyl, and p is a number from 1–7.

Polyetheramines can be prepared by initially condensing an alcohol or alkylphenol with an alkylene oxide, mixture of alkylene oxides, or several alkylene oxides in sequential fashion in a ratio of about 1 mole of alcohol or alkylphenol to 2–50 moles of alkylene oxide to form a polyether intermediate as described in U.S. Pat. No. 5,094,667 . The polyether intermediate can be converted to a polyetheramine by amination with ammonia, an amine or a polyamine as described in published Pat. Application EP 310875. In a preferred route, the polyalkoxylated alcohol or alkylphenol is reacted with acrylonitrile and the resultant nitrile is hydrogenated to form a polyetheramine as described in U.S. Pat. No. 5,094,667.

The aliphatic hydrocarbon-substituted amine of this invention can be derived from a polyolefin having a number average molecular weight of about 500 to 5,000, preferably about 700 to 2,300, and more preferably about 750 to 1,500. A preferred polyolefin is polyisobutylene. The aliphatic hydrocarbon-substituted amine can be prepared by methods known in the art to include chlorinating a polyolefin and then reacting the chlorinated polyolefin with an amine or alkanolamine in the presence of a base such as sodium carbonate as described in U.S. Pat. No. 5,407,453. The amine can be a polyamine to include alkylenepolyamines such as ethylnediamine and polyalkylenepolyamines such as diethylenetrianine. The alkanolamine can be a polyamine such as aminoethylethanoiamine.

The Mannich reaction product of the present invention is derived from an aliphatic hydrocarbon-substituted phenol, an aldehyde, and an amine.

The aliphatic hydrocarbon substituent on the phenol can be derived from a polyolefin having a number average molecular weight of about 500 to 3,000, preferably about 700 to 2,300, and more preferably about 700 to 1,500. A preferred polyolefin is polyisobutylene. A more preferred polyolefin is highly reactive polyisobutylene containing at least 70% of its olefinic double bonds as the vinylidene type at a terminal position on the carbon chain. The aliphatic hydrocarbon-substituted phenol can be prepared by methods well known in the art to include alkylating phenol with a polyolefin using an acidic alkylation catalyst such as boron trifluoride.

The aldehyde used for the Mannich reaction product can be a $C_1$–$C_6$ aldehyde. Formaldehyde is preferred and can be used in one of its reagent forms scuh as paraformaldehyde and formalin.

The amine used for the Mannich reaction product can be a monoamine, polyamine or any organic compound containing at least one

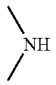

group that is capable of undergoing the Mannich reaction. Polyamines include alkylenepolyamines such as ethylenediamine and dimethylaminopropylamine and polyalkylenepolyamines such as diethylenetriamine.

The Mannich reaction products can be prepared by methods known in the art including those described in U.S. Pat. Nos. 3,877,889 and 5,697,988 and 5,876,468.

The fuel composition of the present invention comprises gasoline and a gasoline additive concentrate composition. The fuel composition is usually prepared by adding the gasoline additive concentrate composition to the gasoline and mixing them at ambient or an elevated temperature up to about 65° C. until the fuel composition is homogeneous.

The gasoline of the present invention is usually a hydrocarbon fuel. The hydrocarbon fuel is typically a liquid fuel, normally a hydrocarbonaceous petroleum distillate fuel such as motor gasoline as defined by ASTM specification D86-00 for a mixture of hydrocarbons having a distillation range from about 60° C. at the 10% distillation point to about 205° C. at the 90% distillation point. Liquid fuel compositions comprising non-hydrocarbonaceous materials such as alcohols, ethers, organo-nitro compounds and the like (e.g., methanol, ethanol, diethyl ether, methyl ethyl ether, methyl t-butyl ether, nitromethane) are also within the scope of this invention as are liquid fuels derived from vegetable or mineral sources such as corn, alfalfa, shale and coal. Liquid fuels that are mixtures of one or more hydrocarbonaceous fuels and one or more non-hydrocarbonaceous materials are also contemplated. An example of such mixtures is the combination of gasoline and ethanol.

The gasoline additive concentrate composition used in the fuel composition comprises a solvent, an alkoxylated fatty amine, and a partial ester having at least one free hydroxyl group and formed by reacting at least one fatty carboxylic acid and at least one polyhydric alcohol. In another instance the concentrate composition used in the fuel composition further comprises a polymeric pour point depressant. In yet another instance the concentrate composition used in the fuel composition further comprises a nitrogen-containing detergent selected from the group consisting of a polyetheramine, an aliphatic hydrocarbon-substituted amine, a Mannich reaction product formed by reacting an aliphatic hydrocarbon-substituted phenol and an aldehyde and an amine, and mixtures of two or more thereof. Each of the gasoline additive concentrate composition components to include the alkoxylated fatty amine, partial ester and nitrogen-containing detergent can be present in the fuel composition on a weight basis at about 10 to 2,000 ppm, preferably at about 20 to 1,000 ppm, and more preferably at about 35 to 250 ppm.

The gasoline additive concentrate compositions and fuel compositions of the present invention can contain other additives that are well known to those of skill in the art. These can include anti-knock agents such as tetra-alkyl lead compounds and MMT (methylcyclopentadienyl manganese tricarbonyl), lead scavengers such as halo-alkanes, dyes, antioxidants such as hindered phenols, rust inhibitors such as alkylated succinic acids and anhydrides and derivatives thereof, bacteriostatic agents, auxiliary dispersants and detergents, gum inhibitors, metal deactivators, demulsifiers, anti-valve seat recession additives such as alkali metal sulphosuccinate salts, anti-icing agents, and fluidizer or carrier oils to include mineral oils, polyolefins, polyethers and polyetheramines. The fuel compositions of this invention can be lead-containing or lead-free fuels. Preferred are lead-free fuels.

A method of operating a gasoline internal combustion engine of this invention comprises fueling the engine with a fuel composition comprising gasoline and a gasoline additive concentrate composition comprising a solvent, an alkoxylated fatty amine, and a partial ester having at least one free hydroxyl group and formed by reacting at least one fatty carboxylic acid and at least one polyhydric alcohol. Additional embodiments of this method of operating the engine include the concentrate composition further comprising pour point depressants or nitrogen-containing detergents as described earlier herein. In still further emobodiments of this invention a method of reducing the fuel consumption of a gasoline internal combustion engine comprises fueling the engine with a fuel composition comprising gasoline and a gasoline additive concentrate composition to include the above-described concentrate compositions.

The following examples in Tables 1–3 are for illustrative purposes and show the effectiveness of the concentrate compositions, fuel compositions and methods of the present invention in reducing fuel consumption in gasoline internal combustion engines. Reduction in engine wear is also indicated by the coefficient of friction performance of the present invention.

TABLE 1

Sequence VIB Dynamometer Test[1]

| Example | Stage 1 Fuel Economy Change[4] | Stage 2 Fuel Economy Change[4] |
|---|---|---|
| 1 (GMO + amine)[2] | +0.30% | +0.58% |
| 2 (GMO + amine + Detergents)[3] | +2.69% | +1.52% |

[1]ASTM Sequence VIB Fuel Economy Test: was run using
a) fuel injected 1993 Ford 4.61 engine under standard test parameters specified for stages 1 and 2 of the ASTM test after a 16 hour aging of engine oil,
b) gasoline reference fuel with additives as indicated and without additives for baseline, and
c) SAE 5W30 SJ/GF-2 engine oil.
[2]Example 1: fuel, 125 ppm by wt. glycerol monooleate (GMO) and 125 ppm by wt. diethoxylated tallowamine (amine).
[3]Example 2: fuel, 125 ppm by wt. glycerol monooleate (GMO) and 125 ppm by wt. diethoxylated tallowamine (amine), 116 ppm by wt. Mannich reaction product (detergent, from 1,000 mol. wt. polyisobutylene alkylated phenol, formaldehyde and ethylenediamine), and 78 ppm by wt. polyetheramine (detergent, from $C_{12-15}$ linear alcohol reacted with 20–24 moles of propylene oxide followed by reaction with acrylonitrile then hydrogenation).
[4]The percent change in fuel economy was determined by comparing fuel consumption based on miles per gallon data of Examples 1 and 2 to a baseline of the reference fuel without additives.

TABLE 2

| Federal Procedure Dynamometer Test[1] | |
|---|---|
| Example | Fuel Economy Change[4] |
| 3 (250 ppm of GMO + amine)[2] | +1.6% |
| 4 (150 ppm of GMO + amine)[3] | +0.9%[5] |

[1]U.S. Federal Test Procedure FTP-75: was run using a Ford Crown Victoria 4.61 V8 gasoline engine on a chassis dynamometer under controlled temperature and humidity for the highway portion of FTP-75 in triplicate for each test.
[2]Example 3: reference fuel, 125 ppm by wt. glycerol monooleate (GMO), and 125 by wt. ppm diethoxylated tallowamine (amine).
[3]Example 4: reference fuel, 75 ppm by wt. glycerol monooleate (GMO), and 75 ppm by wt. diethoxylated tallowamine (amine).
[4]The percent change in fuel economy was determined by comparing fuel consumption based on miles per gallon data of Examples 3 and 4 to a baseline of the reference fuel without additives.
[5]The fuel economy change was based on the results of tests run twice for Example 4 and for the baseline.

TABLE 3

| SRV (Oscillating Friction Wear) Test[1] | | | |
|---|---|---|---|
| Example | Composition[2] | Coefficient of Friction | Reduction in Coefficient of Friction[3] |
| 5 | oil | 0.166 | — |
| 6 | oil + 1% GMO | 0.129 | 22.3% |
| 7 | oil + 0.5% GMO + 0.5% amine | 0.123 | 25.9% |
| 8 | oil + 0.5% GMO | 0.134 | 19.3% |
| 9 | oil + 0.25% GMO + 0.25% amine | 0.124 | 25.3% |
| 10 | oil + 0.25% GMO | 0.145 | 12.7% |
| 11 | oil + 0.125% GMO + 0.125% amine | 0.139 | 16.3% |

[1]SRV (Oscillating Friction Wear) Test: the SRV test device run under a 75 N load at 50 Hz with a 1.5 mm stroke and a temperature ramp to 120° C.
[2]The Examples contain 180 neutral oil and as indicated in weight percent glycerol monooleate (GMO) and diethoxylated tallowamine (amine).
[3]The percent reduction in the coefficient of friction is relative to the oil baseline of Example 5.

What is claimed is:

1. A gasoline additive concentrate composition, comprising:

a solvent that is an aromatic hydrocarbon, a mixture of an alcohol and an aromatic hydrocarbon, or a mixture of an alcohol and a kerosene having some aromatic content;

an alkoxylated fatty amine represented by the formula

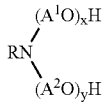

wherein R is a hydrocarbyl group having about 4 to 30 carbon atoms, $A^1$ and $A^2$ are vicinal alkylene groups, and the sum of x and y is at least 1;

a partial ester having at least one free hydroxyl group and formed by reacting at least one fatty carboxylic acid and at least one polyhydric alcohol; and a polymeric pour point depressant wherein the pour point depressant is present in the concentrate composition at 0.001% to 10% by weight, the solvent is present in the concentrate composition at about 25 to 85% by weight, and the concentrate composition is a liquid at a temperature from about 0° C. to minus 18° C.

2. The composition of claim 1 wherein the alkoxylated fatty amine is a diethoxylated fatty amine having about 16 to 18 carbon atoms.

3. The composition of claim 1 wherein the fatty carboxylic acid has about 4 to 30 carbon atoms.

4. The composition of claim 1 wherein the fatty carboxylic acid is a saturated aliphatic monocarboxylic acid or an unsaturated aliphatic monocarboxylic acid.

5. The composition of claim 1 wherein the fatty carboxylic acid is oleic acid.

6. The composition of claim 1 wherein the polyhydric alcohol is glycerol or ethylene glycol.

7. The composition of claim 1 wherein the partial ester is a mixture of glycerol monooleate and glycerol dioleate.

8. The composition of claim 1 wherein the polymeric pour point depressant is a terpolymer formed by polymerizing a dialkyl fumarate, a vinyl carboxylate, and a vinyl ether.

9. A fuel composition, comprising:

gasoline; and the gasoline additive concentrate composition of claim 1.

10. A method of operating and reducing the fuel consumption of a gasoline internal combustion engine comprising fueling the engine with the fuel composition of claim 9.

11. A gasoline additive concentrate composition, comprising:

a solvent that is an aromatic hydrocarbon, a mixture of an alcohol and an aromatic hydrocarbon, or a mixture of an alcohol and a kerosene having some aromatic content;

an alkoxylated fatty amine represented by the formula

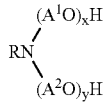

wherein R is a hydrocarbyl group having about 4 to 30 carbon atoms, $A^1$ and $A^2$ are vicinal alkylene groups, and the sum of x and y is at least 1;

a partial ester having at least one free hydroxyl group and formed by reacting at least one fatty carboxylic acid and at least one polyhydric alcohol; and mixtures of two or more nitrogen-containing detergents selected from the group consisting of a polyetheramine, an aliphatic hydrocarbon-substituted amine, and a Mannich reaction product formed by reacting an aliphatic hydrocarbon-substituted phenol and an aldehyde and an amine; wherein the polyetheramine is derived from a polyalkoxylated alcohol or alkylphenol, and the hydrocarbon substituent of the hydrocarbon-substituted amine and the Mannich reaction product is derived from a polyolefin having a number average molecular weight of 700 to 2300.

12. The composition of claim 11 wherein the polyetheramine is formed by hydrogenating a nitrile which is prepared by reacting a polyalkoxylated alcohol or alkylphenol and acrylonitrile.

13. A fuel composition, comprising:

gasoline; and the gasoline additive concentrate composition of claim 11.

14. A method of operating and reducing the fuel consumption of a gasoline internal combustion engine comprising fueling the engine with the fuel composition of claim 13.

15. The composition of claim 11 wherein the mixture of two or more nitrogen-containing detergents comprises a polyetheramine and a Mannich reaction product.

* * * * *